US006422672B1

(12) United States Patent
Searer

(10) Patent No.: US 6,422,672 B1
(45) Date of Patent: Jul. 23, 2002

(54) FRAMELESS APPLIANCE GARAGE ADAPTER

(75) Inventor: Floyd A. Searer, Elkhart, IN (US)

(73) Assignee: FAS Industries, Inc., Elkhart, IN (US)

( * ) Notice: Subject to any disclaimer, the term of this patent is extended or adjusted under 35 U.S.C. 154(b) by 0 days.

(21) Appl. No.: 09/655,840

(22) Filed: Sep. 6, 2000

Related U.S. Application Data

(63) Continuation of application No. 09/276,764, filed on Mar. 26, 1999, now abandoned.

(51) Int. Cl.[7] ..... E06B 9/15

(52) U.S. Cl. ..... 312/297; 312/294; 312/293.1

(58) Field of Search ..... 310/205, 297, 310/238; 403/205, 286, 292, 295, 403, 387, 4

(56) References Cited

U.S. PATENT DOCUMENTS 4,968,171 A * 11/1990 Shell ..... 403/4

* cited by examiner

*Primary Examiner*—Peter M. Cuomo
*Assistant Examiner*—Michael J. Fisher

(74) *Attorney, Agent, or Firm*—Larson & Taylor, PLC; R. J. Lasker

(57) ABSTRACT

An appliance garage with a front panel having left and right side frame members supported in spaced relation by a front panel member extending between the top portions of the left and right side frame members; each of the right and left side frame members including an angled projection extending away from the front of the front panel; a tambour door connected at each respective front side thereof to a respective right and left side frame member; left and right side panel members each having a channel extending substantially the length of the front edge portion and to engage the respective projection of the left and right side frame member so that the side panels extend angled from the tambour door. An adaptor for interconnecting a side panel to an appliance garage front panel and having an elongated member with a single U-shaped channel extending the length of a first side thereof; and including a single projection extending the length thereof along a second side thereof opposite the first side and at an angle to the first side; and the projection of each adapter respectively engaging the respective channel in each frame member and the respective projection of each side panel member engaging the respective channel in each adapter, so that the panel members respectively extend perpendicular to the frame members.

3 Claims, 3 Drawing Sheets

FRAMELESS APPLIANCE GARAGE ADAPTER

This application is a continuation application of application Ser. No. 09/276,764 filed Mar. 26, 1999 abandoned.

BACKGROUND OF THE INVENTION

1. Field of the Invention

This invention relates to appliance garages for storing articles and having decorative side panels, and more particularly to such appliance garages in which the side panels may be attached to the garage appliance at several angles by means of an adapter component that is inserted between engagement projections on adjacent and aligned projections respectively located on a side panel and frame member of the appliance garage, thereby enabling the side panel to project substantially parallel to the frame member or perpendicular to it merely by inserting the adapter between the respective frame member and side panel projections or interconnecting the side panels directly to frame members.

2. Related Art

The following patents are believed to contain information material to the invention disclosed herein:

(1) U.S. Pat. No. 5,588,723, SIVIN; "Adjustable Kitchen Appliance Garage: The shroud and the bottom unit of the garage both have corresponding angular corner pieces to form obtuse angles such that the unit can be positioned in the corner of a kitchen wall as well as on the kitchen wall. However, hinges mounted on each of the respective left and right walls of the garage respectively interconnect the left wall and a left hip, and the right wall and a right hip, to enable each of the third wall and the right wall to be rotated from a perpendicular position to the aforementioned obtuse position.

(2) U.S. Pat. No. 4,261,148; SCOTT; APPARATUS FOR HOLDING BOARDS IN THE MAKING OF FURNITURE

The holding apparatus 10 retains respective first and second rectangular boards in a predetermined orientation with respect to each other. FIG. 5 shows a modified embodiment of the holding apparatus 10 (adapter) in which one board 500 is at an obtuse angle to the other board 510, whereas in FIG. 2 the holding apparatus 10 (adapter) retains the respective boards 20 and 30 perpendicular to one another. However the holding apparatus (adapter) differs for each embodiment.

(3) Other patents, namely U.S. Pat. Nos. 4,840,440, 4,645,374, 4,619.547, 4,712,942 and 5,226,755 each relate to brackets, connector assemblies, etc. for connecting panels together and their respective constructions and relevancy to the subject adapter are believed to be evident from a consideration of the respective drawings in each of the patents.

Notwithstanding the above disclosures, there remains a need in the cabinetry art for improved means for attaching side panels to respective frame members to vary the angle of attachment of the side panels to the respective frame members as set forth herein.

SUMMARY OF THE INVENTION

The adapter of the present invention comprises a U-shaped first portion; a second portion extending at an angle of 45 degrees from the base of the first portion; and a projection extending at a 90 degree angle away from the second portion and 45 degrees from the base of the U-shaped first portion. Each upper side of a front panel spanning, for example, a tambour door of the appliance garage, includes a channel angled at 45 degrees to the front panel. A projection in each of the respective side panels engages a respective channel on each of the front panels thereby providing a side panel extending on each side of the garage at a 45 degree angle to the front panel.

Insertion of the angled projection of the adapter into a respective channel of each of a respective front panel and the U-shaped portion into an opposing channel in the side panel enables each of the respective side panels to extend perpendicular to the front panel of the garage.

The appliance garage of the present invention may employ a tambour door as disclosed in U.S. Pat. No. 4,947,937 and assigned to the same assignee as the present invention.

A primary object of the adapter of the invention is to enable a side panel to be easily connected to a garage at different angles; a feature of the adapter of the present invention is that it is simply inserted in respective opposing channels of the side panel and the front panel of the appliance garage; and an advantage of the adapter of the present invention is that it requires no modification of the side panel or the front panel of the garage.

Another object of the present invention is to provide an adapter that is made of available wood or metal.

Another feature of the adapter of the present invention is that it is easily manufactured from a wood or metal product.

Another advantage of the present invention is that the adapter is not required to be made from a special type of wood or metal.

Another object of the adapter of the present invention is that it may be simply press fit into each of the respective channels of the side panel and front panel of the garage.

A feature of the present invention is that it does not require a special tool for insertion of the adapter into the respective channels of a side panel and a front panel.

An advantage of the adapter of the present invention is that it may be inserted by hand into the respective channels of the side and front panels.

BRIEF DESCRIPTION OF THE DRAWINGS

The foregoing objects, features and advantages of the subject invention are readily apparent from the accompanying description of preferred embodiments of the best mode of carrying out the invention when taken in conjunction with the following drawings, wherein:

FIGS. 3A–3C are respective views of the adapter for interconnecting the respective side panels and front panels of the appliance garage shown in FIG. 1; and wherein FIG. 3A is a top view of the adapter, FIG. 3B is a front view of the adapter showing a projection for engaging the channel in a front panel an FIG. 3C is a perspective view of the adapter showing the channel for engaging the projection on a side panel;

DETAILED DESCRIPTION

Figure 1:
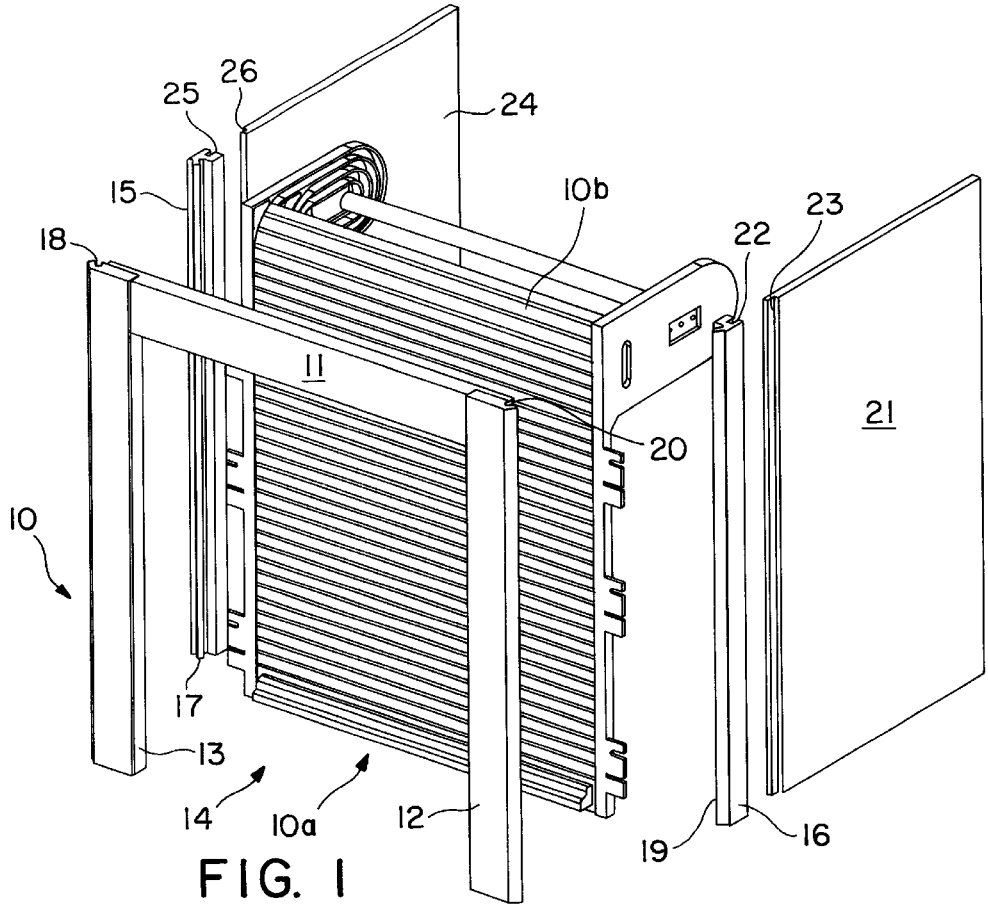
FIG. 1 is an exploded perspective view of the appliance garage adapter according to a preferred embodiment of the invention and illustrating the adapter inserted between respective side panels and front panel of the garage so that the side panels are essentially parallel to one another and perpendicular to the front panels of the appliance garage.

In the exploded perspective view of the appliance garage adapter in accordance with the invention shown in FIG. 1, a front frame 10 comprises top frame member 11, right side frame member 12 and left side frame member 13 connected as shown in the Figure. An appliance garage 10*a* is attached to front frame member 10 so that articles may be moved through the opening 14 and into and out of the appliance garage, respectively. In the embodiment shown in FIG. 1 (and throughout the following description), appliance garage 10*a* has a tambour door 10*b*, for example as described in the aforementioned U.S. Pat. No. 4,947,937. Left side adapter 15 is secured to left side frame member 13 by the engagement of projection 17 in the left side adapter with channel 18 in the left side frame member 13. Similarly right side frame member 12 is attached to adapter 16 via projection 19 in adapter 16 and channel 20 in the right side frame member. Side panel 21 is secured to adapter 16 via the engagement of channel 22 in the adapter 16 with projection 23 on side panel 21. Similarly, side panel 24 is attached to adapter 15 by the engagement of channel 25 in adapter 15 with projection 26 on side panel 24.

The above-described members may be press fit and/or secured by suitable adhesives known to those skilled in the cabinetry art that is pertinent to the invention.

Figure 5:
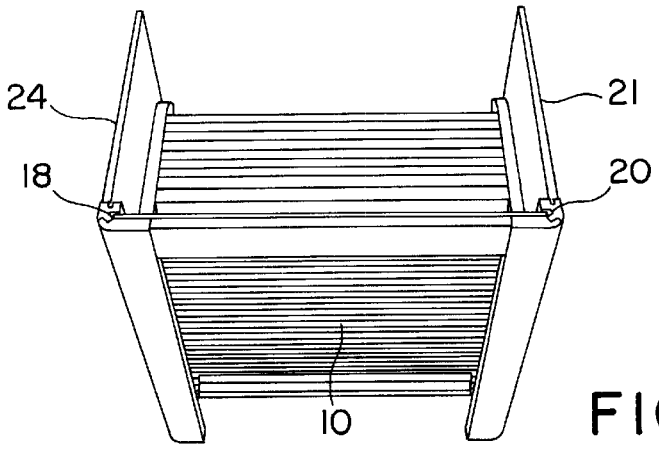
FIG. 5 shows an embodiment of the invention including the adapters between the respective side and front panel members so that the side panels extend perpendicular to the front panel and parallel to the walls of the appliance garage which comprises a tambour door.

The above connection of the adapters with the respective side panels of the appliance garage forms a configuration as illustrated in FIG. 5, which is more fully described herein.

Figure 2:
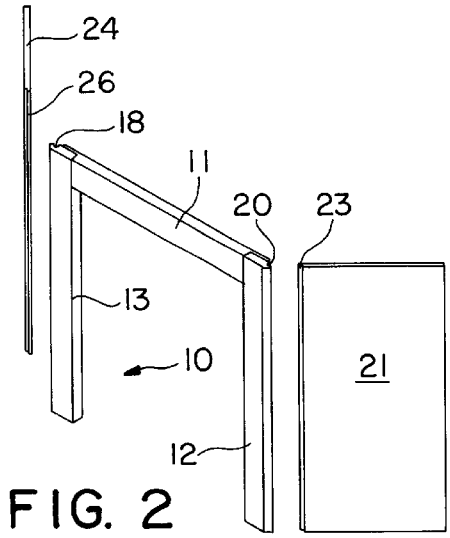
FIG. 2 is an exploded perspective view of the appliance garage adapter as shown in FIG. 1 (without the garage) but with the adapters removed so that the respective side panels directly engage the front panel to extend at an angle of approximately 45 degrees from the front panels.

The exploded view of the appliance garage adapter shown in FIG. 2 illustrates the manner in which the side panels 21, 24 may extend at approximately a 45 degree angle from the plane of the front frame 10 comprising the top frame member 11, right side frame member 12 and left side frame member 13. In FIG. 2, the adapters 15 and 16 of FIG. 1 are not included so that right side panel 21 is directly connected to right side frame member 12 via the engagement of projection 23 on right side panel 21 with channel 20 of the right side frame member. Similarly, left side panel 24 is connected directly to left side frame member 13 by the interconnection of projection 26 of the left side panel with channel 18 of the left side frame member. Thereby, the left side panel 24 and the right side panel 21 extend at an angle of approximately 45 degrees from the plane of the front panel members.

It is thereby evident that the use of the adapters in accordance with the present invention enables the side panels of the appliance garage to be altered between respective first and second positions so that the appliance garage may be located in different configurations such as, for example, a corner, under a diagonal cabinet or as a straight unit under a wall cabinet.

Figure 3A:
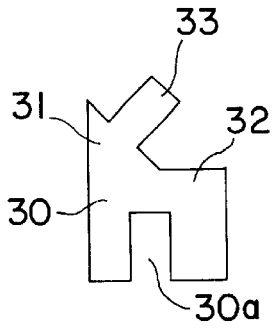
Figure 3C:
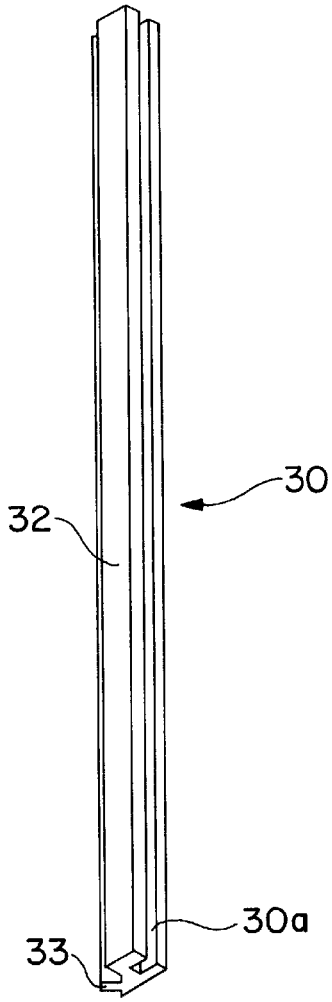
Figure 3B:
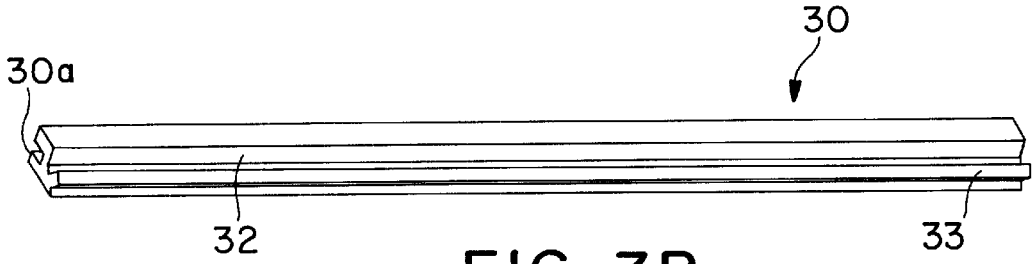

FIGS. 3A–3C respectively illustrate a top view, front view and perspective view of the adapter in accordance with the invention. The adapter of the present invention comprises a U-shaped first portion 30 having therein channel 30*a*; a second portion 31 extending at an angle of 45 degrees from the base 32 of the first portion; and a projection 33 extending at a 90 degree angle away from the second portion and 45 degrees from the base 32 of the U-shaped first portion 30.

Each upper side of a front panel spanning, for example, a tambour door of the appliance garage of the invention, includes a channel angled at 45 degrees to the front panel. A projection in each of the respective side panels engages a respective channel on each of the front panels thereby providing a side panel extending on each side of the garage at a 45 degree angle to the front panel. These components were described above with respect to FIG. 1.

Insertion of the angled projection of the adapter into a respective channel of each of a respective front panel and the U-shaped portion into an opposing projection in the side panel enables each of the respective side panels to extend perpendicular to the front panel of the appliance garage of the invention. This construction was described above with respect to FIG. 1.

Figure 4:
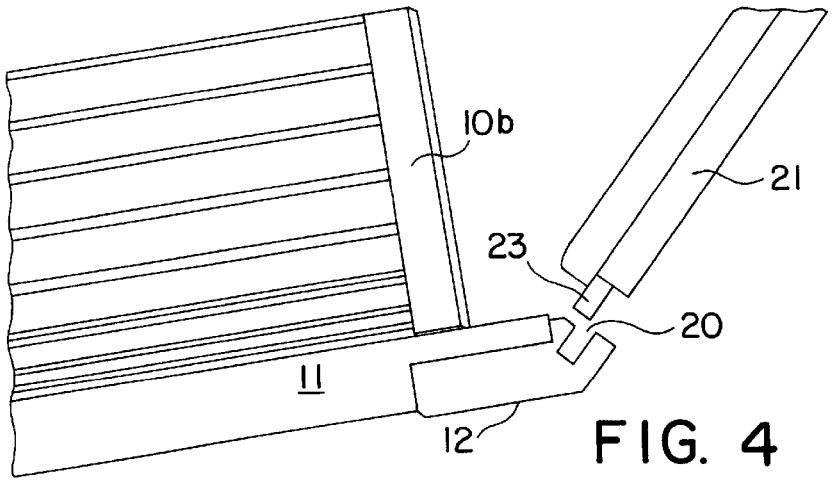
FIG. 4 shows a detail view of the respective channel in a front panel and a projection on the side panel of the appliance garage which engage to attach the side panel at a forty=–five degree angle with respect to the front of the appliance garage.

FIG. 4 is a top view of the appliance garage 10 (tambour door lob), top frame member 11, front right frame member 12 and right side panel 21 showing the manner in which the front panel member 12 and the right side panel 21 are interconnected via the engagement of projection 23 and channel 20, respectively on right side panel 21 and front panel member 12. Using FIG. 4 and the previous description of the structure of the adapter as illustrated in FIGS. 3A–3C, it is readily apparent how the adapter 30 of the invention interconnects between the side panel and the front frame member of the appliance garage. That is, channel 30*a* engages in projection 22, 23 of a side panel member and projection 33 engages in channel 18, 20 of a front panel member to interconnect the respective side panels and the front frame members.

FIG. 5 is a perspective view of a complete appliance garage according to the invention and wherein the adapters enable the respective side panels 21 and 24 to be perpendicular to the front panel assembly 10 as described above with respect to FIG. 1.

Figure 6:
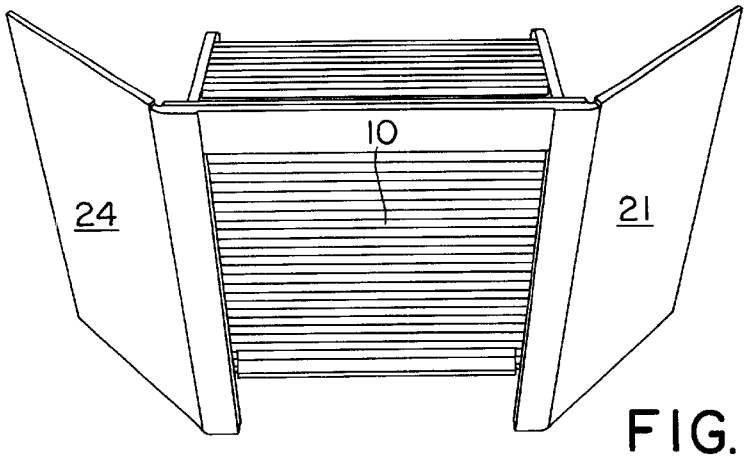
FIG. 6 illustrates a front perspective view of an embodiment of the appliance garage of the present invention with the side panels extending at an angle of approximately 45 degrees from the front panel of the appliance garage and wherein the appliance garage comprises a tambour door.

FIG. 6 is a perspective view of the appliance garage of the invention wherein the side panels are directly attached to the appliance garage so that the respective right and left side panels extend at an angle of approximately 45 degrees to the appliance garage as described above with respect to FIG. 2.

It is desired that the present invention not be limited to the embodiments specifically described, but that it include any and all such modifications and variations that would be obvious to those skilled in the cabinetry art to which the subject invention pertains. It is my intention that the scope of the present invention be determined by any and all such equivalents of the various terms and structure as recited in the following annexed claims.

What is claimed is:

1. An appliance garage, comprising:

a front panel assembly comprising left and right side frame members supported in spaced relation by a front panel member extending between the top portions of said left and right side frame members;

each of said right and left side frame members including a channel extending at an angle away from the front of said front panel assembly;

a door assembly connected at each respective front side thereof to a respective right and left side frame member;

left and right side panel members each having a extending substantially the length of the front edge portion and adapted to engage the respective channel of said left and right side frame member to extend the right and left side panels at an angle from the door assembly.

2. An appliance garage assembly as claimed in claim 1, further comprising a pair of adapters each comprising:

an elongated member having a single U-shaped channel extending the length of a first side thereof; and said elongated member including a single projection extending the length of said member along a second side of said member opposite said first side and at an angle to said first side; and the projection of each said adapter respectively engaging the respective channel in each said right and left side frame member and the respective projection of each said right and left side panel member engaging the respective channel in each said adapter to extend the left and right side panel members respectively perpendicular to said left and right side frame members.

3. An adapter and appliance garage in combination comprising:

the adapter comprising an elongated member including a single U-shaped channel extending the length of a first side thereof, said appliance garage comprising a side panel including a projection attached thereto and engaging said single U-shaped channel;

and said elongated member further including a single projection extending the length of said member along a second side thereof and opposite said first side and at an angle to said first side; and said appliance garage further comprising a front panel including an angled channel adapted to engage said single projection, thereby enabling said side panel to extend substantially perpendicular to said front panel.

* * * * *